US009764811B2

(12) United States Patent
Achiwa et al.

(10) Patent No.: US 9,764,811 B2
(45) Date of Patent: Sep. 19, 2017

(54) OUTBOARD MOTOR

(71) Applicant: SUZUKI MOTOR CORPORATION, Hamamatsu-Shi, Shizuoka-Ken (JP)

(72) Inventors: Tetsushi Achiwa, Hamamatsu (JP); Keisuke Daikoku, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 51 days.

(21) Appl. No.: 15/010,471

(22) Filed: Jan. 29, 2016

(65) Prior Publication Data

US 2016/0229508 A1 Aug. 11, 2016

(30) Foreign Application Priority Data

Feb. 5, 2015 (JP) ..... 2015-020871

(51) Int. Cl.

| | |
|---|---|
| ***B63H 20/06*** | (2006.01) |
| ***B63H 20/12*** | (2006.01) |
| ***B63H 20/24*** | (2006.01) |
| *B63H 20/00* | (2006.01) |

(52) U.S. Cl.

CPC ..... *B63H 20/12* (2013.01); *B63H 20/245* (2013.01); *B63H 2020/003* (2013.01)

(58) Field of Classification Search

CPC ..... B63H 20/12; B63H 20/24; B63H 20/245; B63H 2020/003; F01N 13/08; F01N 13/10; F01N 2230/04; F01N 2590/021

See application file for complete search history.

(56) References Cited

U.S. PATENT DOCUMENTS

| | | | | |
|---|---|---|---|---|
| 6,354,893 | B1 * | 3/2002 | Sato | B63H 20/32 248/640 |
| 7,086,915 | B2 * | 8/2006 | Hikosaka | F02B 61/045 440/88 C |
| 7,524,221 | B2 * | 4/2009 | Hikosaka | B63H 20/00 440/75 |
| 8,690,623 | B2 * | 4/2014 | Suzuki | B63H 20/001 440/88 F |
| 8,690,625 | B2 * | 4/2014 | Kato | B63H 20/245 440/89 H |

FOREIGN PATENT DOCUMENTS

JP 2013-124594 A 6/2013

* cited by examiner

*Primary Examiner* — Ajay Vasudeva
(74) *Attorney, Agent, or Firm* — Barnes & Thornburg LLP

(57) ABSTRACT

In an outboard motor equipped with a V-type four-cycle engine provided with a left bank extending leftward and obliquely rearward and a right bank extending rightward and obliquely rearward, a drive shaft is perpendicularly disposed in the outboard motor body so as to transmit a driving force from the engine to a propeller disposed below the engine, and center positions of the left side exhaust passage and the right side exhaust passage are positioned forward than the drive shaft in a front-and-rear direction in an advancing direction of the outboard motor.

3 Claims, 6 Drawing Sheets

OUTBOARD MOTOR

CROSS REFERENCE TO RELATED APPLICATION

This application is based upon and claims the benefit of priority of the prior Japanese Patent Application No. 2015-020871, filed Feb. 5, 2015, the entire contents of which are incorporated herein by reference.

BACKGROUND OF THE INVENTION

Field of the Invention

The present invention relates to an outboard motor, particularly, for an arrangement of a plurality of outboard motors to be mounted to a hull of a boat or like.

As to an outboard motor, there is a case in which a plurality of outboard motors, for example, two, are mounted to a transom of a hull of a boat or like for the purpose of safety operation and convenience at a time of docking operation, and in a case in which a V-type for stroke-engine (four-stroke-cycle engine) is mounted such as disclosed in Patent Document 1 (Japanese Patent Laid-open No. 2013-124594), because a dimension in the width direction of the outboard motor of such V-type engine becomes large, it is difficult to avoid increasing of size of the outboard motor.

In a case when such large-sized outboard motors are parallel mounted to the hull, it is necessary to set a distance between adjacent two outboard motors to be reduced in a closely adjacent manner. In such arrangement, when the hull is turned by horizontally rotating and steering the bodies of the outboard motors, the distance between the bodies of the adjacent two outboard motors in the width direction thereof is inevitably reduced, and hence, even in a small steering angle, there causes a fear of interference with the adjacent two outboard motors, which results in lowering of the steering performance of the hull.

Moreover, in order to obviate such inconvenience mentioned above, when the adjacent two outboard motors is mounted separately with a large distance to ensure a sufficient steering angle of the bodies of the outboard motors, there causes a fear such that, as shown in FIG. 7B, when the hull 20 is turned, propellers 25 of the outboard motors 10 are came up near water surface level 8 and air is thereby involved, which results in reduction of thrust force, and hence, lowering of the steering performance of the hull.

SUMMARY OF THE INVENTION

The present invention was conceived in consideration of the circumstances mentioned above and an object thereof is to provide an outboard motor capable of sufficiently ensuring a steering angle at a hull turning operation to improve the steering performance of the hull, and ensuring a thrust force of an outboard motor disposed on an outer side in a case where a plurality of outboard motors are mounted parallel to the hull.

The above and other object can be achieved according to the present invention by providing an outboard motor including an outboard motor body equipped with a V-type four-cycle engine provided with a left bank extending leftward and obliquely rearward and a right bank extending rightward and obliquely rearward, and a mount member disposed to a front side portion of the outboard motor body to be detachably and adapted to support the outboard motor body to be rotatable in a horizontal direction through a steering shaft, in which the V-type four-stroke engine includes: a cylinder block in which a cylinder extends in a horizontal direction thereof; a cylinder block fixed to the cylinder block to form a combustion chamber together with the cylinder so as to cover the cylinder, and which is formed with an intake port communicating with the combustion chamber of the engine on an inner side of the outboard motor width direction than a cylinder axis and an exhaust port communicating with the combustion chamber of the engine on an outer side of the outboard motor width direction than the cylinder axis; and a crankcase in which the crank shaft is housed, wherein the left bank and the right bank are formed by the cylinder block and the cylinder head, in which the left bank is formed, on the outer side of the outboard motor width direction than the cylinder, with a left side exhaust passage communicated with the exhaust port formed to the left bank and provided therein with a catalyst, and the right bank is formed, on the outer side of the outboard motor width direction than the cylinder, with a right side exhaust passage communicated with the exhaust port formed to the right bank and provided therein with a catalyst, and wherein a drive shaft is perpendicularly disposed in the outboard motor body so as to transmit a driving force from the engine to a propeller disposed below the engine, and center positions of the left side exhaust passage and the right side exhaust passage are positioned forward than the drive shaft in a front-and-rear direction in an advancing direction of the outboard motor.

According to the present invention of the structure mentioned above, the portions of the outboard motor body corresponding to the left and right side exhaust passages formed to the engine are bulged (expanded) outward in the width direction of the outboard motor body. In addition, the drive shaft is perpendicularly disposed in the outboard motor body so as to transmit a driving force from the engine to a propeller disposed below the engine, and center positions of the left side exhaust passage and the right side exhaust passage are positioned forward than the drive shaft in a front-and-rear direction in an advancing direction of the outboard motor. According to such arrangement, the center positions of the left and right side exhaust passages of the engine are located in close to the steering shaft. As a result, when a plurality of the outboard motors are mounted to a hull, even if the outboard motors are mounted with a small distance between the adjacent ones in the outboard motor width direction, the interference between the adjacent outboard motors in the width direction thereof can be effectively prevented when the hull is turned by applying the steering angle to the outboard motor. Accordingly, the sufficient steering angle for steering and turning the outboard motor body in the horizontal direction can be ensured, thereby improving the maneuverability and steering performance of the hull.

Moreover, since the plural outboard motors can be mounted with a small distance therebetween in the outboard motor width direction, the plural outboard motors can be arranged on the central side of the transom of the hull in the width direction thereof, when the turning the hull, the sufficient thrust force can be ensured without involving outside air by the propeller provided for the outer side outboard motor, thus also improving the steering and turning performance of the hull.

The nature and further characteristic features of the present invention will be made clearer from the following descriptions made with reference to the accompanying drawings.

BRIEF DESCRIPTION OF THE DRAWINGS

FIG. 6 is an illustration of two outboard motors mounted adjacently in parallel to the hull, in which FIG. 7 is an illustration of two outboard motors mounted in parallel to the hull separately from each other, in which

DESCRIPTION OF THE PREFERRED EMBODIMENT

An embodiment of the present invention will be described hereunder with reference to the accompanying drawings. It is to be noted that, in the following descriptions, terms "upper", "lower", "right", "left", "forward", "rearward" and the like terms indicating directions are used with reference to the illustrated state of the drawings or a state mounted to a hull.

[First Embodiment (FIGS. 1 to 6)]

Figure 1:
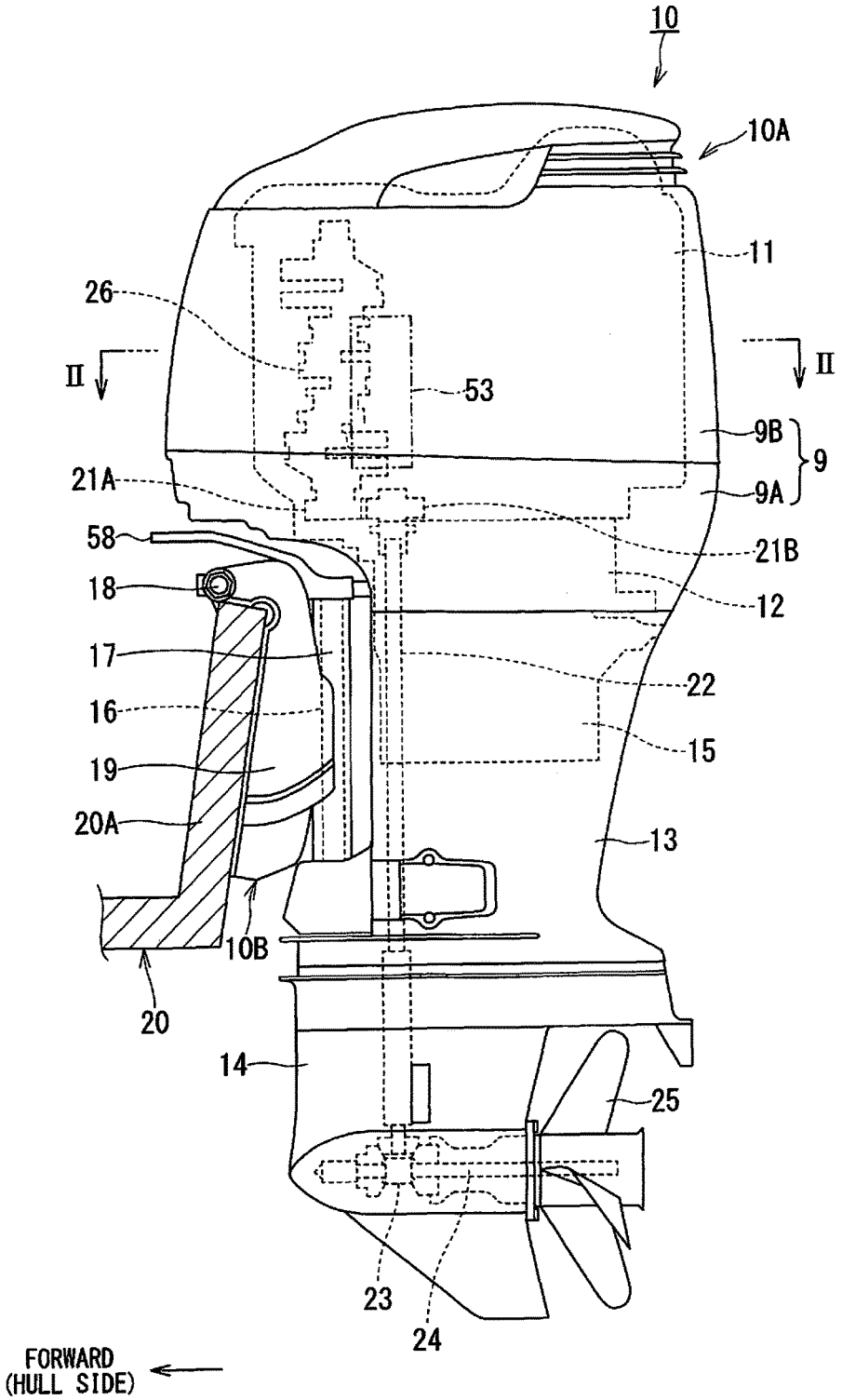
FIG. 1 is a left side view of an outboard motor to which first embodiment of a catalyst installation structure of an outboard motor of the present invention is applied.

With reference to FIG. 1 showing a left side view of an outboard motor to which an embodiment of an outboard motor of the present invention is applied, the outboard motor 10 is equipped with an engine 11, an outboard motor body 10A provided with a propeller 25, and a mount bracket unit 10B as a mount device located to a front side of the outboard motor body 10A and adapted to detachably mount the outboard motor body 10A to a hull 20.

The outboard motor body 10A is provided with an engine holder 12 and the engine 11 is mounted to an upper portion of the engine holder 12. The engine 11 is a vertical-type engine in which a crankshaft 26 (described later) is mounted substantially vertically. A drive shaft housing 13 and a gear case 14 are assembled in sequence under the engine holder 12.

In FIG. 1, an oil pan 15 is located under the engine holder 12 in which a lubricating oil is reserved. A vertically dividable engine cover 9 includes a lower engine cover 9A and an upper engine cover 9B so as to cover the engine 11 and engine holder 12.

The outboard motor 10 is supported pivotally in a horizontal direction by means of a pilot shaft 16 pivotally supported on a swivel bracket 17. The swivel bracket 17 is supported on a swivel shaft 18 pivotally in a vertical direction with respect to a clamp bracket 19, which is attached to a stern (transom) 20A of a hull 20. Consequently, the outboard motor 10 is mounted on the hull 20 swingably in a horizontal direction (steering direction) and vertical direction (trim and tilt direction).

A driving force generated on the crankshaft 26 of the engine 11 is transmitted through reduction gears 21A and 21B to a drive shaft 22 disposed so as to extend substantially vertically in the drive shaft housing 13 and gear case 14 and is then transmitted through a shift mechanism 23 and propeller shaft 24 disposed in the gear case 14 to a propeller 25, thereby turning the propeller 25 in a forward or reverse direction. According to such arrangement, the outboard motor 10 causes the hull 20 to move forward or backward.

The drive shaft 22 of the outboard motor body 10A is arranged in parallel with the swivel shaft 18. The reduction gears 21A and 21B serves to achieve such function as that the drive shaft 22 of the outboard motor body 10A is arranged in a manner offset rearward in a longitudinal (front-and-rear) direction of the outboard motor 10 with respect to the crank shaft 26 of the engine 11.

Figure 2:
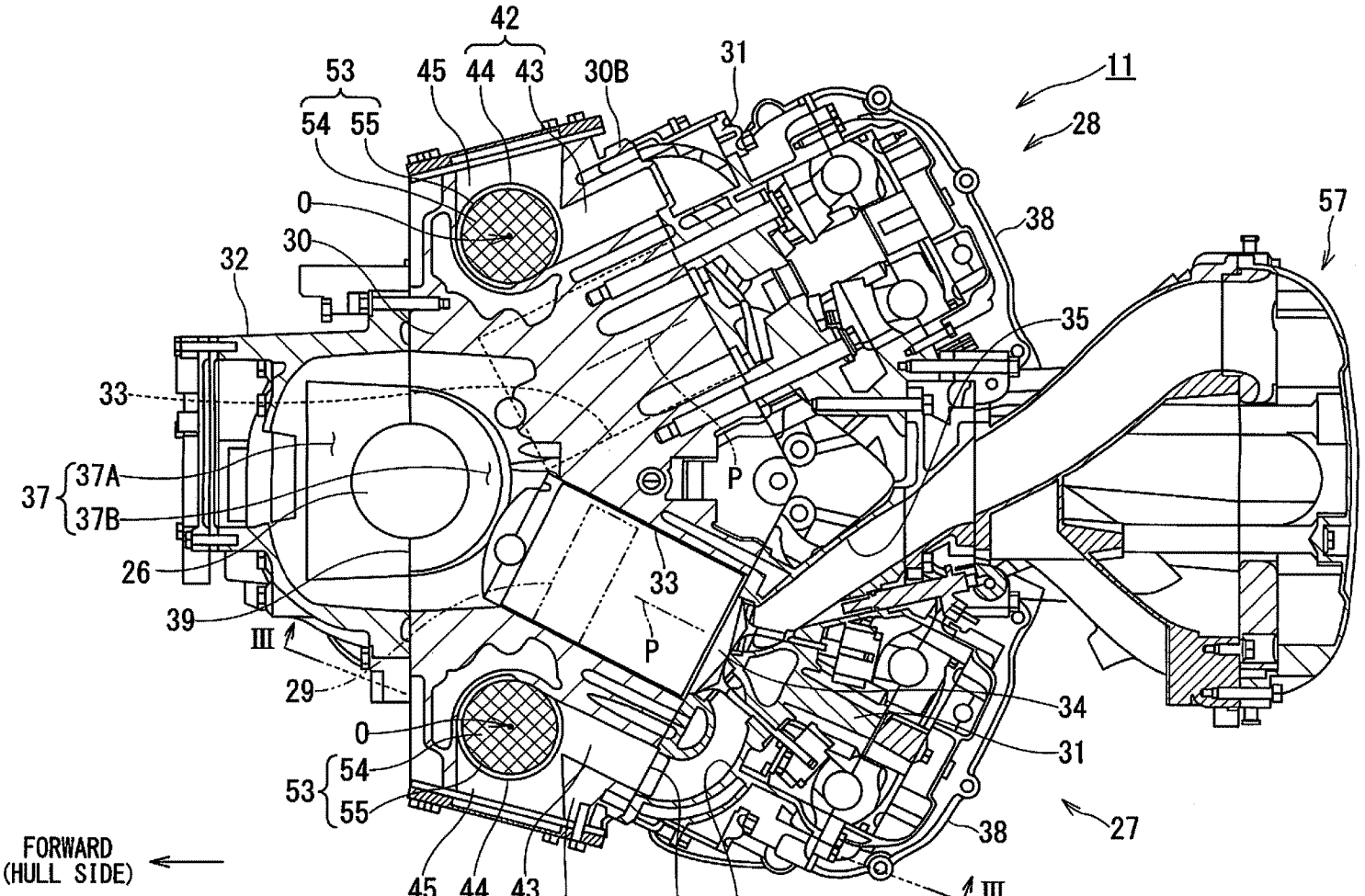
FIG. 2 is a sectional view taken along the line II-II in FIG. 1.

As shown in FIGS. 1 and 2, the engine 11 is a four-stroke V-type engine which includes the crankshaft 26 extending in a vertical direction, a left bank 27 extending diagonally left rearward, and a right bank 28 extending diagonally right rearward. In the four-stroke V-type engine, the left bank 27 is composed of a cylinder head 31 and a cylinder head cover 38 placed in sequence behind a left bank portion 30A of a cylinder block 30, and the right bank 28 is composed of a cylinder head 31 and a cylinder head cover 38 placed in sequence behind a right bank portion 30B of the cylinder block 30. Further, a crankcase 32 is placed in front of the cylinder block 30.

As shown in FIG. 2, cylinders 33 are formed in a horizontal direction inside the left bank portion 30A of the cylinder block 30, extending diagonally left rearward. Cylinders 33 are also formed in a horizontal direction inside the right bank portion 30B of the cylinder block 30, extending diagonally right rearward. Pistons 29 are reciprocally located in the cylinders 33 and coupled to the crankshaft 26 via connection rods, not shown.

Along cylinder axes P of the cylinders 33 in the left bank portion 30A and right bank portion 30B of the cylinder block 30, the cylinder heads 31 are fixed, respectively, to the left bank portion 30A and right bank portion 30B so as to cover the cylinders 33, and concurrently, to form combustion chambers 34 in conjunction with respective cylinders 33 in the left bank portion 30A and right bank portion 30B.

Moreover, in the left bank portion 30A and right bank portion 30B of the cylinder block 30, intake ports 35 communicated with the combustion chambers 34 are formed in the cylinder heads 31 inwardly of the cylinder axes P of the cylinders 33 in a width direction of the outboard motor. Furthermore, in the left bank portion 30A and right bank portion 30B of the cylinder block 30, exhaust ports 36 communicated with the combustion chambers 34 are formed in the cylinder heads 31 outwardly of the cylinder axes P of the cylinders 33 in the width direction of the outboard motor.

The crankcase 32 is coupled to the cylinder block 30, thereby forming a crank chamber 37 in conjunction with the cylinder block 30, and the crankshaft 26 is housed in the crank chamber 37. The crank chamber 37 is dividable by a division surface 39 passing the center line of the crank shaft 26 into a front half section 37A formed to the crank case 30 and a rear half section 37B formed to the cylinder block 30.

Figure 3:
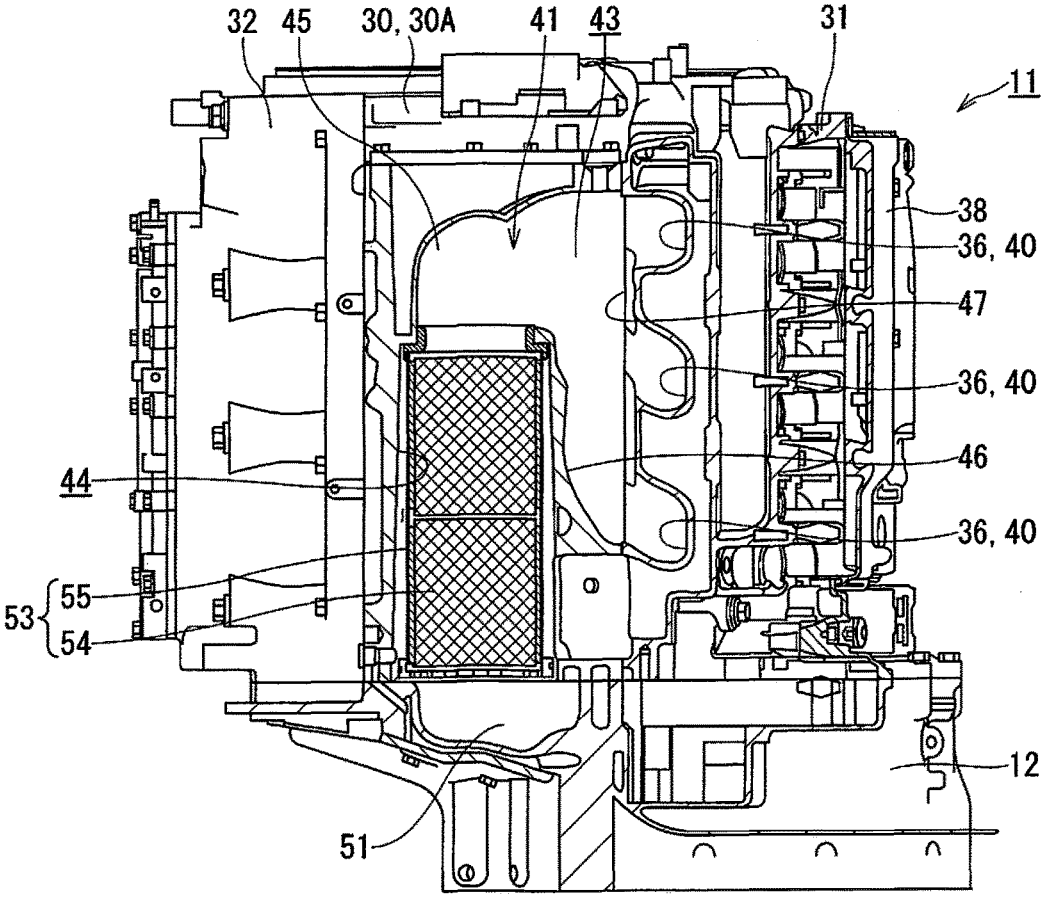
FIG. 3 is a sectional view taken along the line III-III in FIG. 2.
Figure 4:
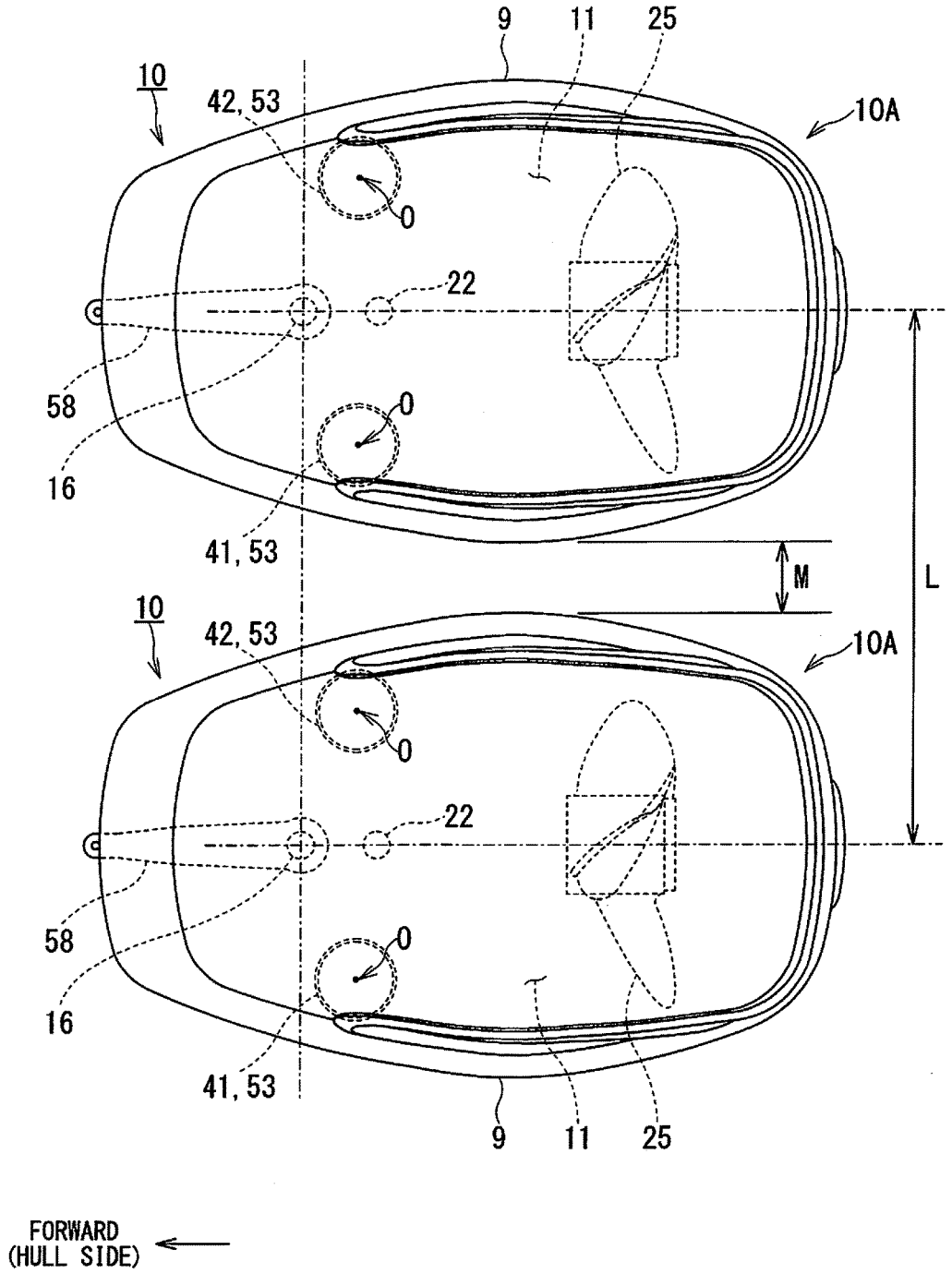
FIG. 4 is a schematic plan view illustrating an arrangement of two outboard motors, each shown in FIG. 1, mounted to a hull in advancing state thereof.

Further, in each of the above-mentioned left bank 27 and right bank 28, plural cylinder assemblies 40 each equipped with a cylinder 33, a combustion chamber 34, an intake port 35, and an exhaust port 36 are arranged side by side in a vertical direction as shown in FIGS. 3 and 4. More specifically, according to the present embodiment, three cylinder assemblies 40 are arranged side by side in the vertical direction in each of the right bank 28 and left bank 27, thus configuring the engine 11 into a V-type six-cylinder four-stroke engine.

As shown in FIGS. 2 and 3, the left bank 27 is formed with a left side exhaust passage 41 which is communicated with each exhaust port 36 of each cylinder assembly 40 provided for the left bank 27 on the outer side than the cylinder 33 in the width direction of the outboard motor 10 and which guides the exhaust gas exhausted from each exhaust port 36 outward of the engine 11, and the left side exhaust passage 41 is also provided therein with a catalytic converter 53 (described hereinafter). Furthermore, the right bank 28 is formed with a right side exhaust passage 42 which is communicated with each exhaust port 36 of each cylinder assembly 40 provided for the right bank 28 on the outer side than the cylinder 33 in the width direction of the outboard motor 10 and which guides the exhaust gas exhausted from each exhaust port 36 outward of the engine 11, and the right side exhaust passage 41 is also provided therein with a catalytic converter 53.

The left side passage 41 is formed integrally with the left bank portion 30A of the cylinder block 30, and the right side passage 42 is formed integrally with the right bank portion 30B of the cylinder block 30. The left side passage 41 is located inside the outward line of the cylinder head 31 constituting the left bank 27 in the width direction of the outboard motor, and the right side passage 42 is located inside the outward line of the cylinder head constituting the right bank 28 in the width direction of the outboard motor. Furthermore, each of the left exhaust passage 41 and right exhaust passage 42 includes an exhaust manifold 43 serving as a first exhaust passage portion and a catalyst storage chamber 44 serving as a second exhaust passage portion.

The exhaust manifold 43 is mounted on at least one of both the lateral sides, in the present embodiment, on both sides, of the cylinder block 30 in the width direction. That is, the exhaust manifold 43 of the left exhaust passage 41 is provided in lateral part of the cylinder block 30 on the left side in the width direction (left bank portion 30A), corresponding to the left bank 27, while the exhaust manifold 43 of the right exhaust passage 42 is provided in lateral part of the cylinder block 30 on the right side in the width direction (right bank portion 30B), corresponding to the right bank 28.

Furthermore, as shown in FIG. 3, in particular, the exhaust manifolds 43 collect the exhaust gas discharged from the respective exhaust ports 36 of the plural cylinder assemblies 40.

In addition, a plurality of exhaust guiding portions 46 are provided for the respective exhaust manifolds 43 of the left exhaust passage 41 and right exhaust passage 42 so as to guide the exhaust gas discharged from the respective exhaust ports 36 of the plural cylinder assemblies 40 to connecting portions 45 between the exhaust manifolds 43 and catalyst storage chambers 44. Each of the exhaust guiding portions 46 is formed as a vertical plane opposed to a joint surface (parting plane) 47 between the cylinder block 30 and the cylinder head 31. The exhaust gas flowing in the exhaust port 36 is guided upward by the exhaust guiding portion 46 in the exhaust manifold 43, and the exhaust gas then reaches the connecting portion 45 between the exhaust manifold 43 and the catalyst storage chamber 44.

As shown in FIG. 2, the catalyst storage chamber 44 in the left exhaust passage 41 is formed integrally on the left bank portion 30A of the cylinder block 30 and the catalyst storage chamber 44 in the right exhaust passage 42 is formed integrally on the right bank portion 30B of the cylinder block 30, both being, for example, substantially circular in passage section.

As shown in FIG. 3, the catalyst storage chambers 44 are communicated with both the connecting portions 45 of the exhaust manifolds 43 and an exhaust passage 51 of the engine holder 12, thereby connecting exhaust manifolds 43 with an exhaust silencing chamber (i.e., muffler), not shown, inside the drive shaft housing 13 installed outside the engine 11. Then, catalytic converters 53 having, for example, a circular shape in section for purifying the exhaust gas are installed and housed in the catalyst storage chambers 44.

Each catalytic converter 53 is configured such that a catalyst carrier 54 formed into, for example, a columnar shape and equipped with an exhaust purification function is housed in a catalyst tube 55, having a cylindrical shape, for example. When the catalyst carrier 54 comes into contact with exhaust gas, it chemically changes toxic substances such as carbon monoxide, hydrocarbon, nitrogen oxides, and the like contained in the exhaust gas into water, carbon dioxide, nitrogen or the like via oxidation-reduction reactions to thereby purify the exhaust gas.

Accordingly, the exhaust gas produced in the combustion chambers 34 of the plural cylinder assemblies 40 in the left bank 27 and right bank 28 of the engine 11 shown in FIG. 2, flows through the exhaust ports 36 of the cylinder assemblies 40 in the left bank 27 and right bank 28 and into the respective exhaust manifolds 43 of the left exhaust passage 41 and right exhaust passage 42.

As shown in FIG. 3, the exhaust gas flowing into each exhaust manifold 43 ascends by being guided by the exhaust guiding portion 46, and then reaches the connecting portion 45 between the exhaust manifold 43 and the catalyst storage chamber 44. The exhaust gas flows downward in the connecting portion 45 into the catalytic converter 53 in the catalyst storage chamber 44 in order to be purified.

The exhaust gas purified by the catalytic converters 53 flows downward into the exhaust silencing chamber of the drive shaft housing 13, thereby being expanded and silenced (muffled) therein. Subsequently, the exhaust gas flows in an exhaust passage, not shown, formed around the propeller shaft 24 in the gear case 14 shown in FIG. 1 and is discharged into water from a center of the propeller 25.

In FIG. 2, reference numeral 57 denotes an intake manifold connected to the intake port 35 of the engine 11 and adapted to introduce fuel/air mixture into the combustion chamber 34 through the intake port 35.

Incidentally, as shown in FIGS. 1 and 4, the drive shaft 22 is provided in a manner offset in the longitudinal (front-and-rear) direction of the outboard motor 10 with respect to the crank shaft 26 of the engine 11 so as to extend in a perpendicular direction in parallel with the steering shaft 16. Then, the central positions "O" of the catalyst storage chamber 44 (or catalytic converter 53 housed in the catalyst storage chamber 44) in the left and right exhaust passages 41 and 42 of the engine 11 are positioned on the front side of the drive shaft 22 and the rear side of the steering shaft 16 in the longitudinal direction of the outboard motor, that is, positioned between the drive shaft 22 and the steering shaft 16.

According to the arrangement described above, as shown in FIG. 4, in a case when a plurality (two in the present embodiment) of outboard motors 10 are mounted to the transom 20A of the hull 20 are mounted in parallel with each other, and when the outboard motor bodies 10A are turned horizontally to turn the outboard motors 10 (shown in FIG.

5), both the steering performance and turning (swiveling) performance can be improved.

Figure 6A:
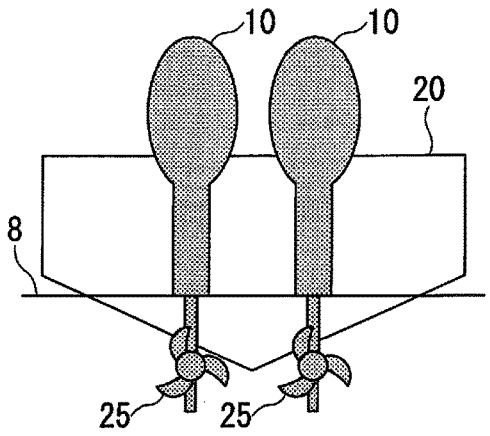
FIG. 6A is a rear side view of the hull in the hull advancing state.
Figure 6B:
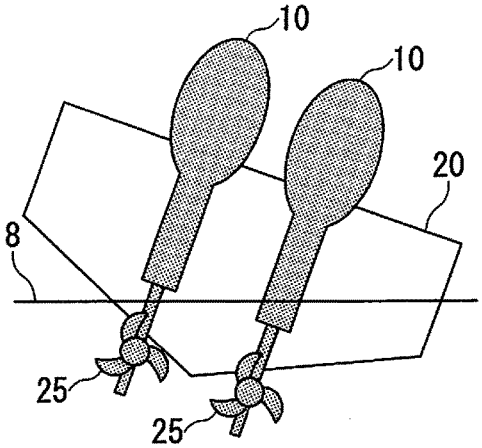
FIG. 6B is a rear side view of the hull in the hull turning state rightward.
Figure 7A:
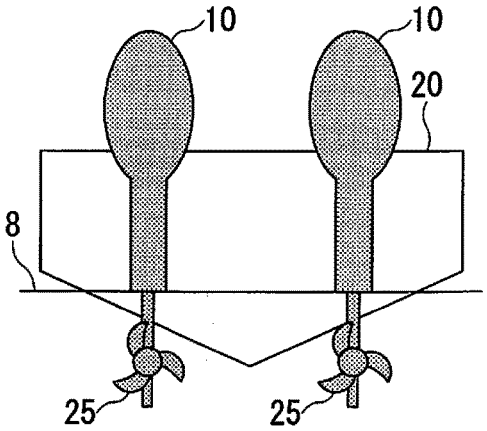
FIG. 7A PRIOR ART
FIG. 7A is a rear side view of the hull in the hull advancing state.

That is, in the case when a plurality of outboard motors 10 are mounted in parallel to the transom 20A of the hull 20, it is more preferred in turning or swiveling performance of the hull 20 with the close arrangement of the adjacent outboard motors 10 as shown in FIG. 6 than the separate arrangement thereof as shown in FIG. 7.

Figure 7B:
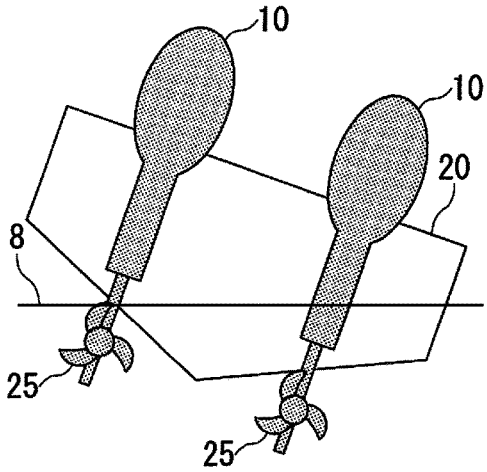
FIG. 7B PRIOR ART
FIG. 7B is a rear side view of the hull in the hull turning state rightward.

More specifically, in the case of the separate arrangement of the plural outboard motors 10, when the hull 20 is turned, as shown in FIG. 7B, the propeller 25 of the outboard motor 10 positioned on the outer side from the turning center may rise and approach the water surface 8 and involve the outside air, resulting in lowering of the thrust force.

On the other hand, in the case of the close arrangement of the plural outboard motors 10, when the hull 20 is turned, as shown in FIG. 6B, the propeller 25 positioned on the outer side from the turning center does not approach the water surface 8 and not involve the outside air, thus ensuring sufficient thrust force. This thrust force of the outboard motor 10 positioned on the outer side of the turning center acts to the outer side of the gravity of the hull 20 at the turning operation thereof and to generate the turning moment, so that the close arrangement of the outboard motors 10 according to the present embodiment can effectively contribute to the improvement of the turning or swiveling performance of the hull 20.

Furthermore, in the engine cover 9 of the outboard motor body 10A, parts including portions corresponding to the left and right side exhaust passages 41 and 42 of the engine 11 are bulged (i.e., expanded) in the outboard motor width direction. In the arrangement of the plurality of outboard motors 10, the distance between the adjacent two ones 10 mounted to the transom 20A of the hull 20 is set to "L" in the advancing operation as shown in FIG. 6A, the distance between the maximally bulged portions of the engine covers 9 of the outboard motor bodies 10A becomes "M" in the outboard motor width direction as shown in FIG. 4. In this state, the set distance "L" corresponds to, for example, the distance between the steering shafts 16 of the adjacent two outboard motors 10.

Figure 5:
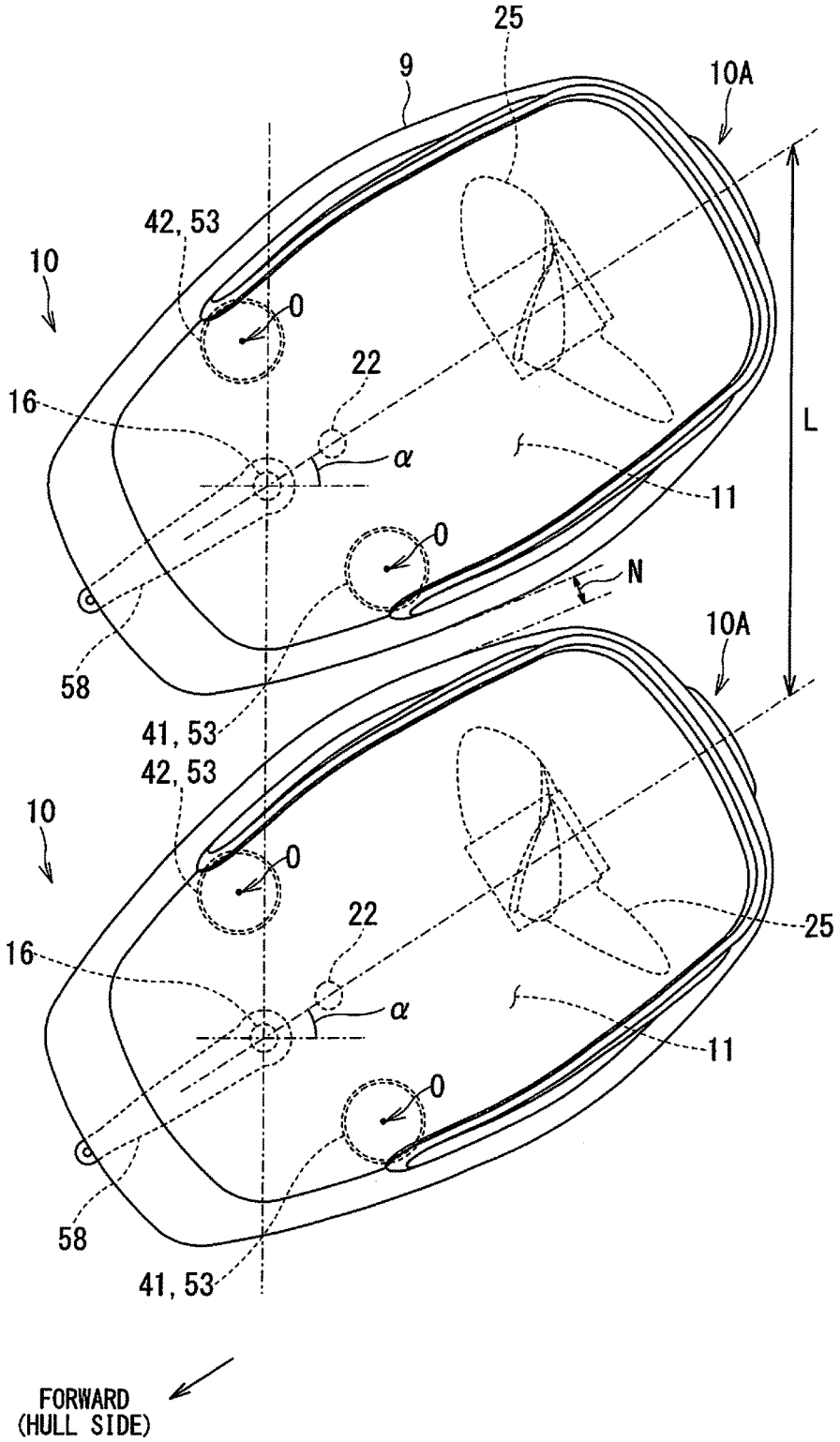
FIG. 5 is a schematic plan view illustrating an arrangement of two outboard motors, each shown in FIG. 1, mounted to a hull in turning state thereof.

On the other hand, as shown in FIG. 5, when the outboard motor bodies 10A are turned horizontally around the steering shafts 16, the outboard motors 10 take the state shown in FIG. 6B, and a distance between a forward portion and a rearward portion of the maximally bulged portions of the engine covers 9 becomes "N" in the outboard motor width direction, which is generally smaller than the distance "M". In the present embodiment, the left and right side exhaust passages 41 and 42 of the engine 11 are arranged in the forward portion of the maximally bulged portion of the engine cover 9.

Therefore, even in the case when a plurality of the outboard motors 10 are arranged closely to each other with the distance "L" in order to improve the turning or swiveling performance of the hull 20, it is necessary not to bulge and expand outward the left and right side exhaust passages 41 and 42 of the engine in the outboard motor width direction to ensure the distance "N" between the outboard motor bodies 10A at the turning operation of the hull 20 by applying the steering angle α (FIG. 4) of the outboard motor bodies 10A of the plural outboard motors 10 arranged in parallel each other. Further, reference numeral 58 in FIGS. 4 and 5 denotes a steering bracket secured to the steering shaft 16 for horizontally turning the outboard motor body 10A around the steering shaft 16.

Furthermore, as shown in FIG. 4, in the arrangement in which the center positions "O" of the left and right side exhaust passages 41 and 42 of the engines 11 of the outboard motor bodies 10A are respectively positioned between the steering shafts 16 and the drive shafts 22 in the longitudinal direction of the outboard motors 10, the left and right side exhaust passages 41 and 42 are located closely to the steering shafts 16. According to such arrangement, as shown in FIG. 5, when the hull 20 is turned at which the outboard motor bodies 10A are turned in the horizontal direction around the steering shafts 16 by applying the steering angle α, the rotating (turning) radius of each of the left and right side exhaust passages 41 and 42 with the steering shaft 16 being the center of the rotation is made small. Because of this reason, at the turning operation of the hull 20, the distance "N" between the adjacent outboard motor bodies 10A of the plural outboard motors can be sufficiently ensured, and hence, the interference between the adjacent outboard motor bodies 10A in the width direction of the outboard motors 10 can be effectively prevented.

As described above according to the present embodiment, since the left and right side exhaust passages 41 and 42 can be disposed closely to the steering shafts 16, respectively, the steering angle α for rotating and steering the outboard motor body 10A in the horizontal direction can be sufficiently largely ensured, thus enabling the effective maneuverability and steering performance of the hull 20 to be improved. Furthermore, since the distance "N" between the adjacent outboard motor bodies 10A of the plural outboard motors can be sufficiently ensured at the turning operation of the hull 20 by applying the steering angle α to the outboard motor bodies 10A of the plural outboard motors 10. Accordingly, a plurality of outboard motors 10 can be mounted to the hull 20 closely to each other with the small distance "L" between the adjacent outboard motors 10, thereby effectively improving the turning or swiveling performance of the hull 20.

It is apparent that although the present invention was described hereinabove with reference the preferred embodiment in which a plurality of outboard motors are mounted to a hull, the outboard motor itself can be manufactured as single one, and accordingly the present invention of course concerns to a single outboard motor.

According to the structure and arrangement of the present embodiment described above, the following advantageous effects (1) and (2) can be achieved.

(1) As shown in FIGS. 4 and 5, in the engine cover 9 of the outboard motor body 10A, parts including portions corresponding to the left and right side exhaust passages 41 and 42 of the engine 11 are bulged (i.e., expanded) in the outboard motor width direction. In addition, the drive shaft 16 is disposed on the rear side of the steering shaft 16 in the longitudinal (front-and-rear direction) of the outboard motor, and the center positions "O" of the left and right side exhaust passages 41 and 42 are positioned in front of the drive shaft 22. Accordingly, the left and right side exhaust passages 41 and 42 can be disposed with the center portions "O" thereof being close to the steering shaft 16.

Therefore, when a plurality of the outboard motors 10 are mounted to the transom 20A of the hull 20, the outboard motors 10 can be mounted with a small distance "L" in the outboard motor width direction, and hence, even in a case when the distance "M" between the adjacent outboard motor bodies 10A in the outboard motor width direction in the advancing operation becomes smaller, the distance "N" between the adjacent outboard motor bodies 10A of the plural outboard motors 10 in the outboard motor width direction can be sufficiently ensured at the time when the hull 20 is turned by applying the steering angle α to the outboard motor body 10A, and hence, the interference between the outboard motor bodies 10A in the width direction thereof can be effectively prevented. As a result, the sufficiently large steering angle α for turning and steering the outboard motor body 10A in the horizontal direction can be ensured, thus improving the maneuverability and the steering performance of the hull 20.

Furthermore, since the distance between the adjacent ones of the plural outboard motors is set to be small in the outboard motor width direction, the plural outboard motors 10 can be arranged near the central position in the width direction thereof, the propeller 25 positioned on the outer side from the turning center does not approach the water surface 8 and not involve the outside air, thus ensuring sufficient thrust force, so that the close arrangement of the outboard motors 10 according to the present embodiment can effectively contribute to the improvement of the turning or swiveling performance of the hull 20.

(2) In addition, as shown in FIG. 2, in the engine 11 of each outboard motor body 10A, the left side exhaust passage 41 and the right side exhaust passage 42 are formed inside the cylinder block 30 to be integrally therewith. Accordingly, in comparison with an arrangement in which the left and right side exhaust passages 41 and 42 are bulged (expanded) outward from the cylinder block 30 in the outboard motor, according to the present embodiment, since the engine can be designed in compact, making it possible to provide a small-sized outboard motor, and thus, being advantageous. Such advantageous effect becomes more apparent by arranging the catalyst storing chambers 44 in the left and right side exhaust passages 41 and 42 inside the outline of the cylinder head 31 in the width direction of the outboard motors 10.

It is to be noted that the present invention is not limited to the embodiments described above as preferred examples, and many other changes, modifications, and alternations may be made without departing from the sprits of the present invention and scope of the appended claims.

What is claimed is:

1. An outboard motor comprising:

an outboard motor body equipped with a V-type four-cycle engine provided with a left bank extending leftward and obliquely rearward and a right bank extending rightward and obliquely rearward; and a mount member disposed to a front side portion of the outboard motor body to be detachably and adapted to support the outboard motor body to be rotatable in a horizontal direction through a steering shaft, the V-type four-stroke engine including: a cylinder block in which a cylinder extends in a horizontal direction thereof; a cylinder head fixed to the cylinder block to form a combustion chamber together with the cylinder so as to cover the cylinder, and which is formed with an intake port communicating with the combustion chamber of the engine on an inner side of the outboard motor width direction than a cylinder axis and an exhaust port communicating with the combustion chamber of the engine on an outer side of the outboard motor width direction than the cylinder axis; and a crankcase in which a crank shaft is housed, wherein the left bank and the right bank are formed by the cylinder block and the cylinder head, in which the left bank is formed, on the outer side of the outboard motor width direction than the cylinder, with a left side exhaust passage communicated with the exhaust port formed to the left bank and provided therein with a catalyst, and the right bank is formed, on the outer side of the outboard motor width direction than the cylinder, with a right side exhaust passage communicated with the exhaust port formed to the right bank and provided therein with a catalyst, and wherein a drive shaft is perpendicularly disposed in the outboard motor body so as to transmit a driving force from the engine to a propeller disposed below the engine, and center positions of the left side exhaust passage and the right side exhaust passage are positioned forward than the drive shaft in a front-and-rear direction in an advancing direction of the outboard motor.

2. The outboard motor according to claim 1, wherein the drive shaft of the outboard motor body is disposed in a manner offset rearward in the front-and-rear direction of the outboard motor with respect to the crank shaft of the V-type four-stroke engine, and the center positions of the left side exhaust passage and the right side exhaust passage are provided to a position between the steering shaft and the drive shaft in the front-and-rear direction of the outboard motor.

3. The outboard motor according to claim 1, wherein a left bank side cylinder and a right bank side cylinder of the V-type four-stroke engine are formed to the cylinder block together with a rear half section of a crank chamber housing the crank shaft, and the left side exhaust passage and the right side exhaust passage are formed integrally.

* * * * *